US007216902B2

(12) United States Patent
Marra et al.

(10) Patent No.: US 7,216,902 B2
(45) Date of Patent: May 15, 2007

(54) PORTABLE DOOR LOCK

(76) Inventors: Aldo Marra, P.O. Box 398, Davis, CA (US) 95617; Yael Marra, 644 Alvarado, Apt. 231, Davis, CA (US) 95616

( * ) Notice: Subject to any disclaimer, the term of this patent is extended or adjusted under 35 U.S.C. 154(b) by 0 days.

(21) Appl. No.: 10/624,792

(22) Filed: Jul. 22, 2003

(65) Prior Publication Data

US 2005/0017518 A1 Jan. 27, 2005

(51) Int. Cl.
*E05C 19/18* (2006.01)

(52) U.S. Cl. ..... 292/288; 292/251.5; 292/292

(58) Field of Classification Search ..... 292/251.5, 292/288, 289, 292, 295
See application file for complete search history.

(56) References Cited

U.S. PATENT DOCUMENTS

| | | | | |
|---|---|---|---|---|
| 827,624 | A | 7/1906 | Foster | |
| 848,644 | A | 4/1907 | Flegel | |
| 1,234,158 | A | 7/1917 | Hall | |
| 1,958,940 | A | 5/1934 | Cavanaugh et al. | |
| 2,396,982 | A | 3/1946 | Bousquet | |
| 2,673,755 | A * | 3/1954 | Asp | 292/78 |
| 3,039,806 | A | 6/1962 | Rice | |
| 3,416,333 | A | 12/1968 | Weingart | |
| 3,475,929 | A | 11/1969 | Weingart | |
| 3,589,761 | A | 6/1971 | Lambert | |
| 3,731,965 | A * | 5/1973 | Adkison, Jr. | 292/292 |
| 4,004,833 | A | 1/1977 | Hull | |
| 4,155,578 | A | 5/1979 | Rolland | |
| 4,386,797 | A | 6/1983 | Duran, Sr. | |
| 4,399,672 | A * | 8/1983 | Moorhouse | 70/101 |
| 4,471,981 | A | 9/1984 | Wright | |
| 4,575,140 | A | 3/1986 | Dargis | |
| 4,603,895 | A | 8/1986 | Langenbahn | |
| 4,605,251 | A | 8/1986 | Finlay | |
| 4,770,451 | A * | 9/1988 | Souza | 292/289 |
| 4,898,411 | A | 2/1990 | Ocello et al. | |
| 4,964,662 | A | 10/1990 | O'Leary et al. | |
| 5,193,866 | A | 3/1993 | Driskill et al. | |
| 5,360,245 | A | 11/1994 | David et al. | |
| 5,401,068 | A | 3/1995 | Barnard | |
| 5,480,200 | A | 1/1996 | Aintablian | |
| 5,685,580 | A | 11/1997 | West et al. | |
| 5,704,665 | A * | 1/1998 | Budolfson | 292/295 |
| 5,836,626 | A | 11/1998 | Coy | |
| 6,416,089 | B1 | 7/2002 | Williams, Jr. | |
| 6,641,185 | B2 * | 11/2003 | Hale et al. | 292/289 |

FOREIGN PATENT DOCUMENTS

| | | |
|---|---|---|
| FR | 762 352 | 10/1933 |
| FR | 2411291 | 12/1977 |
| GB | 278523 | 10/1926 |

* cited by examiner

*Primary Examiner*—Gary Estremsky
(74) *Attorney, Agent, or Firm*—Daniel P. Maguire

(57) ABSTRACT

A portable door lock with a strike plate, a bolt, and a magnet is disclosed. The strike plate has a boss that fits into the recess of a door frame, and has at least one aperture for accommodating the bolt. The strike plate may also have a handle for gripping by the user when inserting the strike plate into the recess of a door frame. Once the strike plate is fitted into the recess of a door frame, a bolt is inserted through the aperture or apertures, and the magnet is placed in the area between the door, the strike plate, and the bolt. The door is thereby secured, without the need for any tools.

4 Claims, 5 Drawing Sheets

PORTABLE DOOR LOCK

BACKGROUND OF THE INVENTION

1. Field of the Invention

The present invention relates to portable door locks.

2. Background of the Invention

Portable door locks of various designs have been created to secure doors that do not have operable locks, or for travelers or others who wish to personally control access to a room. Such portable door locks can be especially useful in public accommodations, including hotels, dormitories, apartments, and cruise ships.

Prior portable door locks possess several disadvantages. Many are complex and not cost effective to manufacture. Others can be picked, and those with securing pins can be wrenched or pried from the outside by intruders. Some portable door locks include notches, teeth or contain rough edges which may cause injury to the user during installation or removal. A number of portable door locks require special tools to install, or can only work with doorknobs or doorknob shanks of a specific size or shape. Still other portable door locks mar the door when installed, or detract from the door's appearance. Chain locking portable door locks have a low yield strength, and allow the door to be opened several inches, which makes it possible for the chain to be cut by an intruder. Thus, previous portable door locks have not enjoyed large scale commercial acceptance.

Therefore, there is a need for an improved portable door lock that does not damage doors or door frames, and that is simple, secure, compact, strong, lightweight, and inexpensive to manufacture.

SUMMARY OF THE INVENTION

The present invention is a portable door lock comprising a strike plate, a magnet, and a bolt.

DETAILED DESCRIPTION

Figure 1:
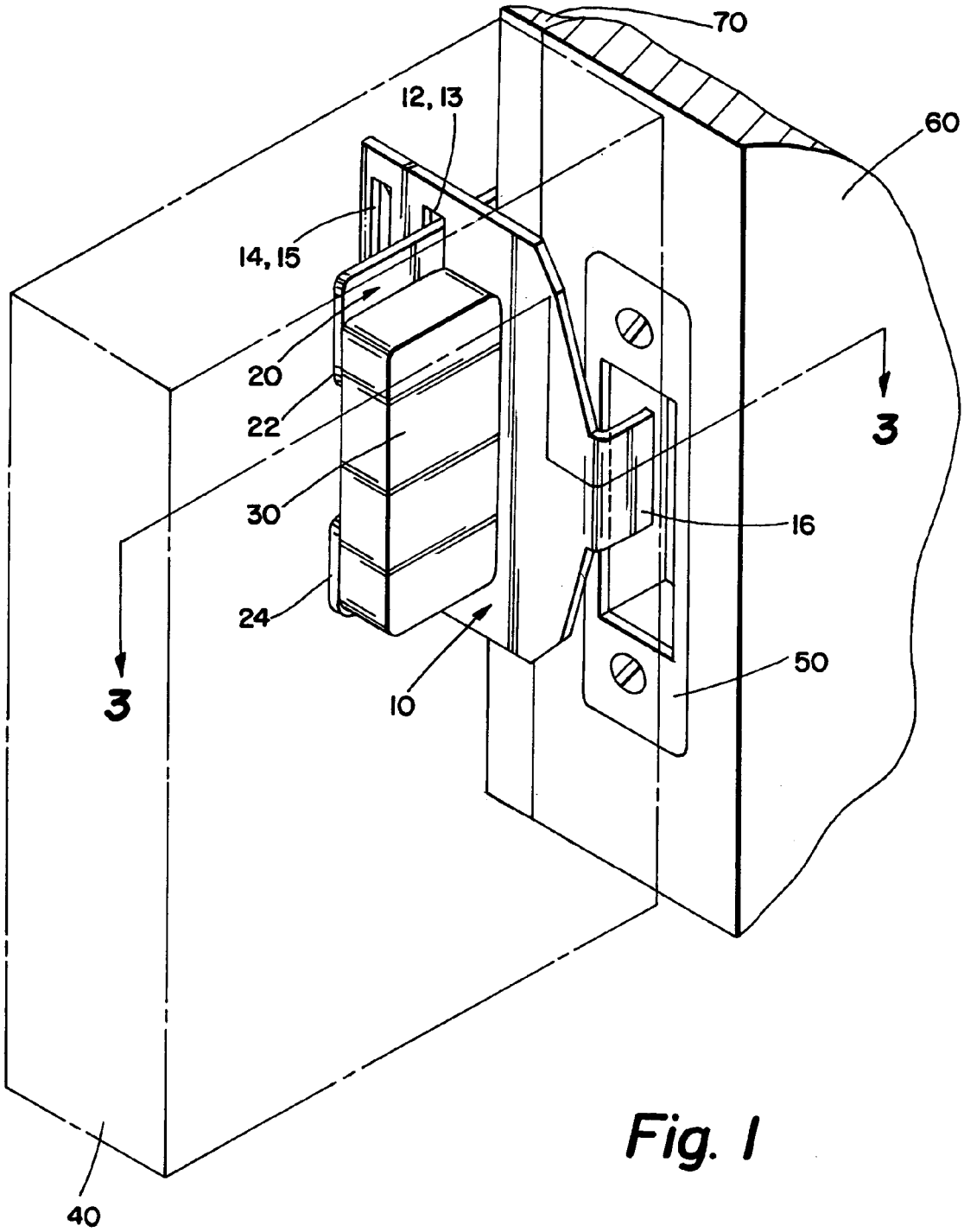
FIG. 1 is an environmental perspective view of a door and door frame with a portable door lock according to an embodiment of the present invention.
Figure 2:
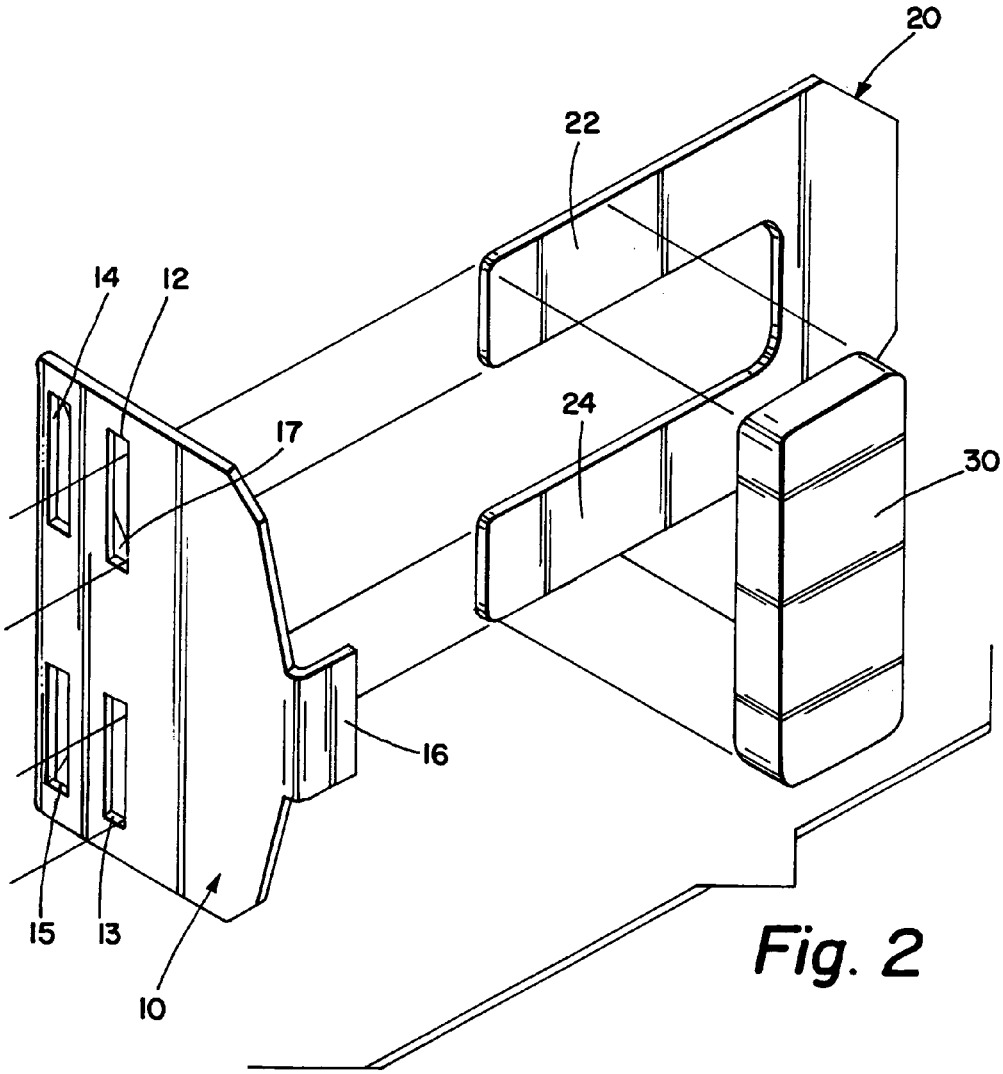
FIG. 2 is an exploded perspective view of a portable door lock according to an embodiment of the present invention.

The present invention is a portable door lock comprising: a strike plate 10, a U-bolt 20, and a magnet 30. As shown in FIGS. 1, 2, 3, 4, 7, and 8, the strike plate 10 is a plate-type structure with apertures (12, 13, 14, 15) for the U-bolt, and with a protuberance or boss 16 for holding the strike plate 10 in the recess of the deadbeat latch 50 or doorknob strike plate.

Figure 3:
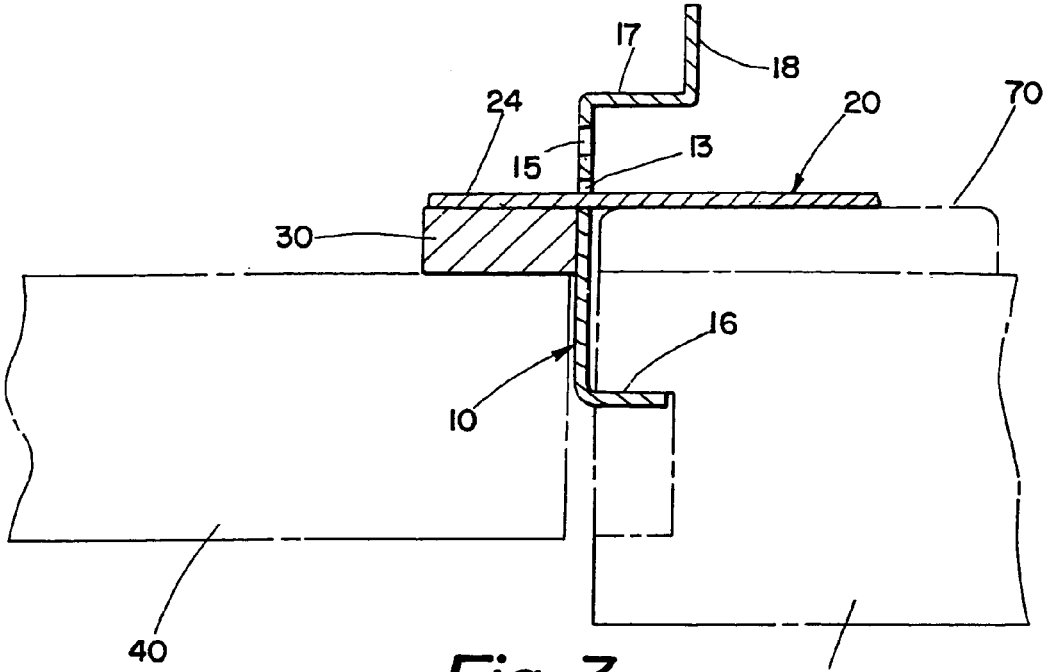
FIG. 3 is a top cross-section view taken along lines 3—3 of FIG. 1.
Figure 4:
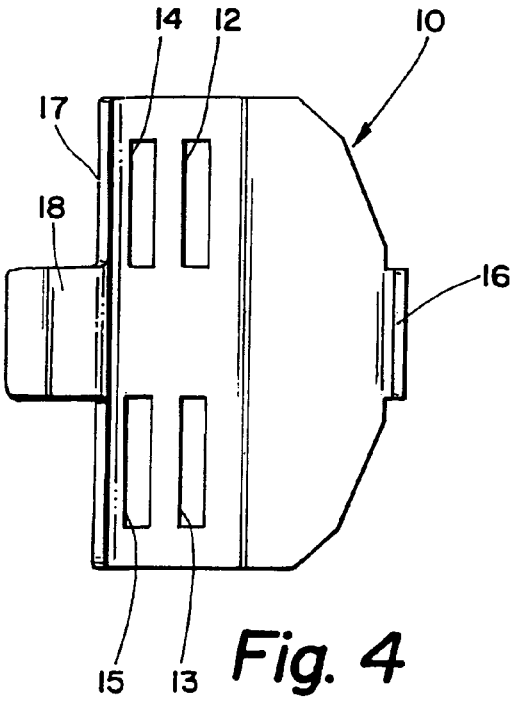
FIG. 4 is a side view of a strike plate according to an embodiment of the present invention.
Figure 5:
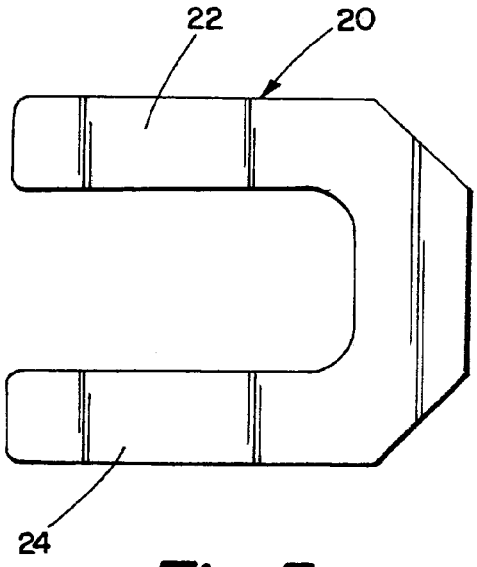
FIG. 5 is a side view of a U-bolt according to an embodiment of the present invention.
Figure 6:
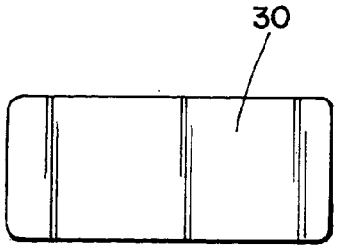
FIG. 6 is a side view of a magnet according to an embodiment of the present invention.
Figure 7:
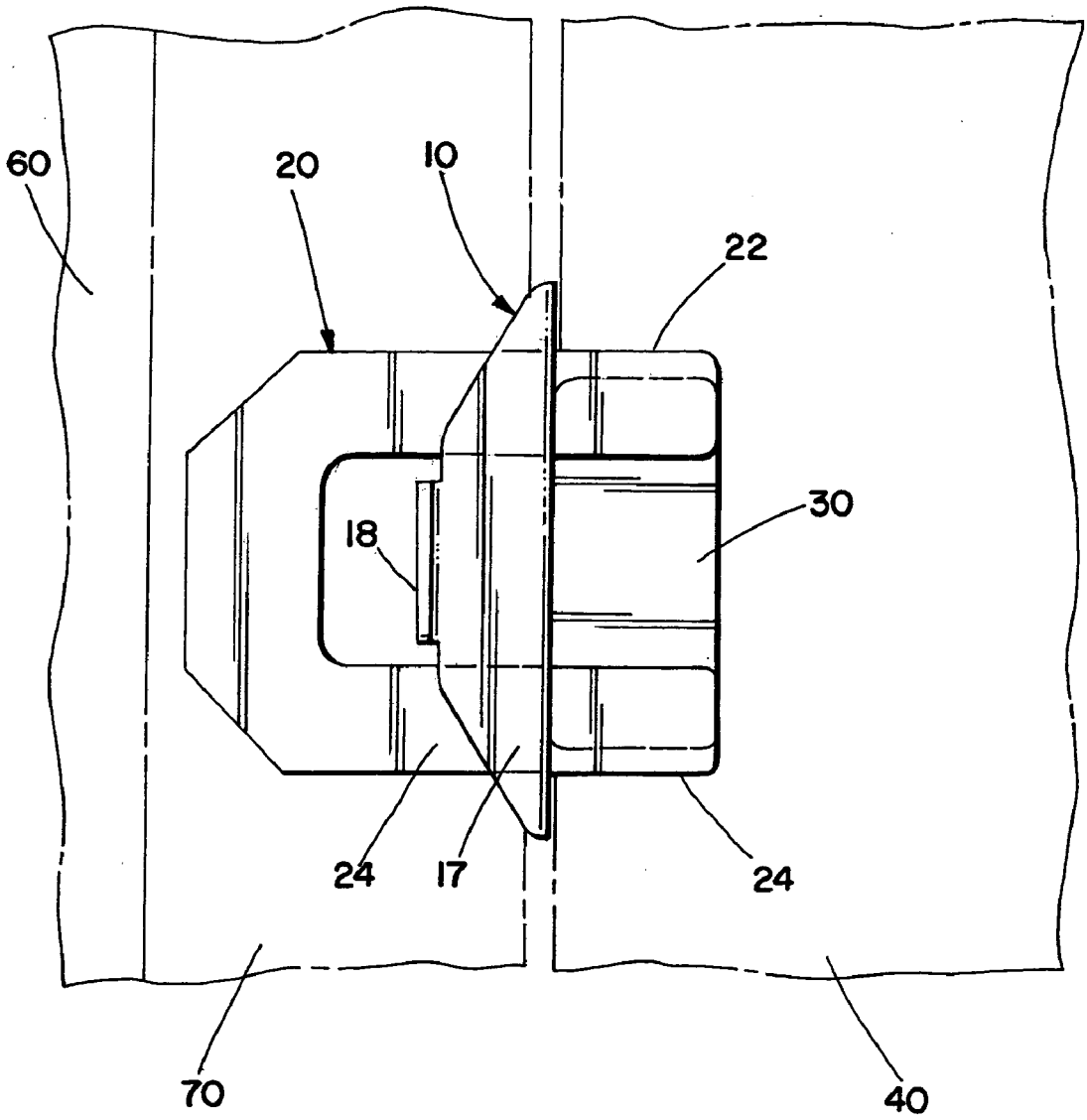
FIG. 7 is a front view of a portable door lock according to an embodiment of the present invention, as installed in a door.
Figure 8:
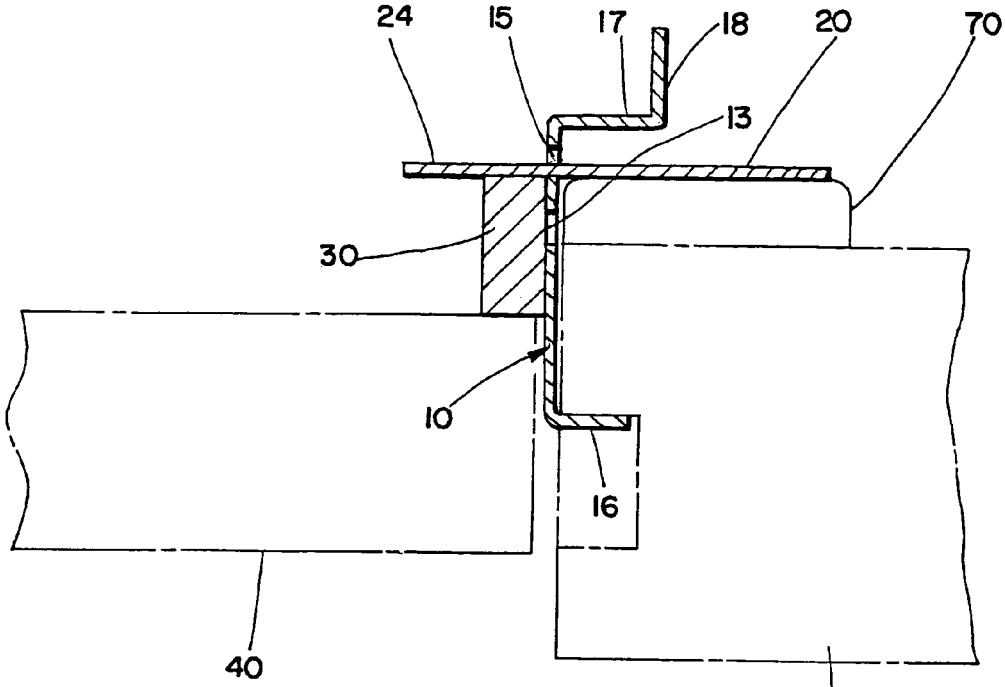
FIG. 8 corresponds to the view of FIG. 3, but shows a portable door lock according to an embodiment of the present invention as configured for a door with a greater displacement between the molding and the door than in FIG. 3.

In one embodiment, the strike plate 10 has two sets of apertures. See FIG. 2. The first set of apertures 12, 13 can be used when the distance between the molding 70 and the door 40 is relatively small, as shown in FIG. 3. The second set of apertures 14, 15 can be used when the distance between the door molding 70 and the door 40 is relatively greater, as shown in FIG. 8. In alternative embodiments, one set of apertures can be used, or even a single aperture.

The strike plate 10 also has a hooked boss 16 at one end that engages the recess within a dead bolt latch 50 of a door frame 60, see FIGS. 1, 3 and 8, or the recess of a conventional doorknob strike plate within a door frame 60. Thus the present invention can work with any door frame that has a recess, whether that recess is part of a dead bolt or conventional door lock.

The strike plate 10 also has an arm 17, and a handle 18. See FIGS. 2, 3, 4, 7, 8. Users can grip the handle 18 when inserting the strike plate 10 into the recess of the door frame, thereby making installation easier.

The strike plate 10 can be made of many different materials, including metals such as iron and stainless steel, or metal coated plastic, or magnetized ceramic.

As shown best in FIGS. 2, 3, 5, 7, and 8, the U-bolt 20 has arms 22, 24 for fitting through the strike plate's apertures 12, 13, 14, 15. Like the strike plate, the U-bolt 20 can be made of many different materials, including but not limited to metals such as iron and stainless steel, or metal coated plastic, or magnetized ceramic.

Although a U-bolt is shown, many different types of bolts or fastening devices can be used with the present invention. For instance, in one alternative embodiment, the U-bolt could have a pin that is placed between slots at the end of the U-bolt, thereby improving the U-bolt's strength. For purposes of this patent, the term "bolt" shall be used to generically denote any bolt, pin, or other structure that can fit into or through the aperture or apertures of the strike plate.

The magnetic bar 30 can be virtually any magnet that is sized and shaped so as to fit in the area between the strike plate 10, the U-bolt 20, and the door 40. See FIG. 1. As shown in FIGS. 1, 2, 3, 6, 7, and 8, in one embodiment the magnetic bar 30 is rectangular. The magnet can be sized so that when positioned in one orientation, it can accommodate a relatively narrow offset between the molding 70 and the door 40, and when positioned in a second orientation, it can accommodate a relatively wide offset between the molding 70 and the door 40. Compare FIGS. 3 and 8. The magnet can be made of traditional metallic materials, as well as magnetized ceramic.

The magnetic bar 30 also advantageously holds the pieces of the present invention together when the device is in its unassembled state. Thus, the magnet helps prevent loss of either the strike plate 10 or the U-bolt 20.

In one embodiment, both the U-bolt 20 and the strike plate 10 are made of materials that are capable of attracting and holding the magnetic bar 30. However, it is not necessary that both items be made of magnet-attracting materials—the invention can function so long as one of these items, or even just the appropriate part of one of these items, can hold attract and hold the magnetic bar 30.

In operation, the user grips the portable door lock by the handle 18, then places the boss 16 into the recess of the deadbeat latch 50 or doorknob strike plate. The door 40 is then closed, and the U-bolt 20 is placed through either set of apertures 12, 13, 14, 15, and the magnet is placed between the arms 22, 24 of the U-bolt, the body of the strike plate 10, and the door 40. See FIGS. 1, 2. The magnet 30 adheres to the arms of the U-bolt 22, 24 and/or the body of the strike plate 10 and presses onto the face of the door 40. See FIGS. 1 & 2. The end of the U-bolt 20 opposite to the arms presses firmly against the door frame molding 70, thus precluding inward opening of the door. The device keeps the door securely closed and cannot be disengaged from the outside by an intruder.

The portable door lock of the present invention has many different applications, including use in public accommodations, such as hotels, dormitories, apartments, and cruise ships. The present invention may also be useful to prevent unwanted entry by the holder of a master key.

In addition to providing effective security, the device of the present invention is small, lightweight and easily packed. Having only three parts, it is easy and quick to install and uninstall, with no tools required. The device is durable and reliably constructed, as well as easily and efficiently manufactured and marketed. The present invention requires no particular door, handle, or door frame configuration, other than a standard strike plate with a recess. Neither installation nor removal of the device will damage, alter or mar the door, door frame or associated parts.

One skilled in the art will appreciate that the present invention can be practiced by other than the preferred embodiments, which are presented for purposes of illustration and not of limitation.

We claim:

1. A portable door lock comprising:

a strike plate having a first end and a second end;

two pairs of apertures at said first end of said strike plate;

a boss for insertion into a recess within a door frame at said second end of said strike plate;

a U-bolt for insertion into said apertures; and a magnet for adherence to said bolt and/or said strike plate.

2. The portable door lock according to claim 1, wherein said magnet is sized so as to be capable of fitting in two distinct orientations when adhering to said bolt and/or said strike plate.

3. A portable door lock comprising:

a metal strike plate having a first end and a second end;

two pairs of apertures at said first end of said strike plate;

a boss for insertion into a recess within a door frame at said second end of said strike plate;

a metal U-bolt for insertion into one of said two pairs of apertures; and a magnet for adherence to said bolt and said strike plate.

4. A method of locking a door, comprising:

providing a strike plate with a handle, a boss at one end and two pairs of apertures at the other end;

gripping said strike plate by said handle, and inserting said boss into a recess within a door frame;

inserting a bolt through said aperture, so that said bolt is substantially perpendicular to said strike plate; and inserting a magnet in an area directly adjacent to said bolt, directly adjacent to said strike plate, and directly adjacent to said door, thereby locking said door.

* * * * *